US005356454A

United States Patent [19]

Itoyama et al.

[11] Patent Number: 5,356,454

[45] Date of Patent: Oct. 18, 1994

[54] MOLD POWDER FOR CONTINUOUS CASTING

[75] Inventors: Seiji Itoyama, Chiba; Hidenari Kitaoka, Okayama; Toshikazu Sakuraya, Chiba; Kenichi Sorimachi, Chiba; Saburo Moriwaki, Chiba; Sumio Yamada, Chiba; Chikashi Tada, Chiba; Takahiro Mitumune; Shinichi Kaneko, both of Hyogo; Masafumi Maeda, Saitama, all of Japan

[73] Assignee: Kawasaki Steel Corporation, Hyogo, Japan

[21] Appl. No.: 98,139

[22] Filed: Jul. 28, 1993

[51] Int. Cl.[5] ..... C21C 7/076; B22C 1/00

[52] U.S. Cl. ..... 75/305; 75/309; 75/327; 501/125

[58] Field of Search ..... 75/305, 309–311, 75/325, 327; 501/125, 135

[56] References Cited

U.S. PATENT DOCUMENTS

| | | | |
|---|---|---|---|
| 4,235,632 | 11/1980 | Uher et al. | 75/305 |
| 4,594,105 | 6/1986 | Grimm et al. | 75/305 |
| 4,806,163 | 2/1989 | Nakato et al. | 75/305 |
| 5,234,488 | 8/1993 | Ichikawa et al. | 75/309 |

*Primary Examiner*—George Wyszomierski
*Attorney, Agent, or Firm*—Dvorak and Traub

[57] ABSTRACT

A mold powder for use in continuous casting, containing specified amounts of CaO, $Al_2O_3$, $TiO_2$, $Li_2O$, BaO, MgO, F and $Na_2O$, and further containing at least one of BN and C as aggregate. The mold powder, when used in continuous casting of a steel rich in strong reducing metal elements such as Al, Ti, REM and so forth, remarkably suppresses generation of deterioration in the surface quality of the slab and break out of the slab which are attributable inferior lubrication.

2 Claims, No Drawings

MOLD POWDER FOR CONTINUOUS CASTING

BACKGROUND OF THE INVENTION

1. Field of the Invention

The present invention broadly relates to continuous casting of a steel which contains slag reducing metal elements such as Al, Ti, REM (Rare Earth Metal) or the like and, more particularly, to a mold powder which can effectively be used for improving lubrication between the steel and the mold in order to avoid problems such as deterioration of the surface quality of the slab and break out of the slab which otherwise may occur due to inferior lubrication.

2. Description of the Related Art

Hitherto, in continuous casting of a steel containing 0.010 wt % or more Al, reducing reactions take place in accordance with the following formulae (1) and (2) between Al component in the molten steel and low-grade oxides such as $SiO_2$, MnO and so forth contained in the powder which is used for providing lubrication between the mold wall and the slab and for covering the surface of the molten steel. At the same time, $Al_2O_3$ in the molten steel, which is a deoxidation product or a product of secondary oxidation of the molten steel, floats in the molten steel in the mold so as to be trapped by the powder.

$$\underset{\text{(Molten steel)}}{4Al} + \underset{\text{(Molten powder)}}{3(SiO_2)} \longrightarrow \underset{\text{(Molten powder)}}{2(Al_2O_3)} + \underset{\text{(Molten steel)}}{3Si} \quad (1)$$

$$2Al + 3(MnO) \longrightarrow (Al_2O_3) + 3Mn \quad (2)$$

Consequently, the molten powder composition is changed to enhance the tendency of generation of $2CaO.Al_2O_3.SiO_2$ (gehlenite), which undesirably promotes generation of slag and impairs lubrication.

Under this circumstance, methods are being developed which can avoid the above-mentioned change in the molten powder composition despite the increase in the $Al_2O_3$ content in the powder, thereby ensuring stable casting while preventing deterioration of the surface quality of the product slab.

For instance, Japanese Patent Laid-Open No. 61-186155 discloses a powder which contains BaO and $Li_2O$, with the composition adjusted to meet the conditions of $BaO+CaO+SiO_2=60$ to 80 wt % and $CaO/SiO_2=0.30$ to 0.60 wt %.

Japanese Patent Laid-Open No. 63-10052 discloses a powder having a composition meeting the condition of $CaO/SiO_2=0.6$ to 0.8, melting point of 800° to 1000° C. and viscosity of 1300° C. $<1.5$ poise. Japanese Patent Laid-Open No. 3-77753 proposes a powder containing 10 to 20 wt % of $SiO_2$ and not more than 15 wt % of $Al_2O_3$, the $SiO_2$ and $Al_2O_3$ contents being determined to meet a specific condition.

All these proposed powders, however, have $SiO_2$ content ranging from 10 to 40 wt % and, therefore, cannot completely eliminate the above-described problems. Thus, when these known powders are used, thermit reactions take place in accordance with the aforesaid formulae (1) and (2) to generate heat, thus posing the following problems.

(i) Generation of bleed (small scale of breakage of solidification shell) along oscillation mark due to delay of solidification at the meniscus.

(ii) Reduced Si is mixed in the molten steel to make the Si content of the molten steel fall out of the target range. At the same time, Al in the molten steel is changed to $Al_2O_3$ to make the Al content fall out of the target range. Consequently, the desired composition of molten steel cannot be obtained.

(iii) Flame is formed as a result of the thermit reaction, which causes danger in the casting operation, making it difficult to safely continue the casting.

Meanwhile, Japanese Patent Publication No. 63-56019 proposes a powder in which $SiO_2$ content is diminished as much as possible so as to avoid the reaction in accordance with the aforesaid formula (1).

This powder has an increased CaO content of 40 to 60 wt % at the cost of the reduced $SiO_2$ content. Therefore, the powder exhibits inferior fluidity, which impairs lubrication of the steel resulting in deterioration of the surface quality of the product slab.

SUMMARY OF THE INVENTION

Accordingly, an object of the present invention is to provide a powder which can suppress, in continuous casting of a steel containing slag reducing metal elements such as Al, Ti, REM and so forth, any tendency of deterioration of the slab surface quality or break out of the slab attributable to inferior lubrication effect.

Briefly, the powder in accordance with the present invention contains, as the major components, CaO, $Al_2O_3$, $TiO_2$, $Li_2O$, BaO, MgO and $Na_2O$ but does not substantially contain $SiO_2$.

According to one aspect of the present invention, there is provided a mold powder for continuous casting, having a composition which contains: from 10 to 35 wt % of CaO, from 10 to 35 wt % of $Al_2O_3$, from 3 to 15 wt % of $TiO_2$, from 3 to 20 wt % of $Li_2O$, from 5 to 40 wt % of BaO, not more than 15 wt % of F, not more than 20 wt % of $Na_2O$, at least one of from 0.5 to 4.0 wt % of BN and from 0.5 to 4.0 wt % of C as aggregate, and the balance inevitable impurities.

The above and other objects, features and advantages of the present invention will become clear from the following detailed description of the invention.

DETAILED DESCRIPTION OF THE INVENTION

Throughout intense study and experiments, the present inventors have found that the above-described problems of the prior art is overcome by using a powder having a $CaO-Al_2O_3$ type basic composition avoiding as much as possible inclusion of $SiO_2$ and with addition of suitable amounts of $TiO_2$ and $Li_2O$ which have a large effect on lowering the melting point.

More specifically, the powder of the present invention has a composition which contains: from 10 to 35 wt % of CaO, from 10 to 35 wt % of $Al_2O_3$, from 3 to 15 wt % of $Ti_2O$, from 3 to 20 wt % of $Li_2O$, from 5 to 40 wt % of BaO, not more than 15 wt % of F, not more than 20 wt % of $Na_2O$, from 0.5 to 4.0 wt % of BN and from 0.5 to 4.0 wt % of C as aggregate, and the balance inevitable impurities.

A description will now be given of the reasons of limiting the contents of the respective elements. $TiO_2$: from 3 to 15 wt %

Known mold powders rich in $SiO_2$ are expected to lower the melting point while promoting vitrification. When $Al_2O_3$ content of the powder is increased as a result of the reaction of the aforesaid formula (1), the large $SiO_2$ content of the powder leads to generation of $2CaO.Al_2O_3.SiO_2$ (gehlenite) which exhibits high melting point.

In contrast, the mold powder in accordance with the present invention, $TiO_2$ is added in an amount of 3 to 15 wt % while $SiO_2$ is minimized. $TiO_2$ exhibits vitrification promoting effect as is the case of $SiO_2$ and exhibits a reducing rate which is about half that of $SiO_2$ in the molten steel. Furthermore, in the case of a $CaO$-$Al_2O_3$ type slag (powder), addition of 3 to 15 wt % of $TiO_2$ causes about 200° to 300° C. reduction in the melting point of the powder as compared with the case where no $TiO_2$ is added. The effect to lower the melting point, however, is not appreciable when the $TiO_2$ content is below 3 wt % and when the same exceeds 15 wt %. For these reasons, the $TiO_2$ content in the powder is determined to be from 3 to 15 wt %. $Li_2O$: from 3 to 20 wt %

Addition of 3 to 20 wt % of $Li_2O$ to a CaO—$Al_2O_3$—$TiO_2$ slag offers the same effect as that produced by the addition of $TiO_2$. Addition of $Li_2O$ also produces an effect to energize activity of $Al_2O_3$ in the molten slag so as to suppress oxidation of Al in the molten steel. These effects, however, are not noticeable when the content of $Li_2O$ is below 3 wt %. Addition of $Li_2O$ in excess of 20 wt % is not preferred because it enhances the tendency of the reduction of $Li_2O$ in accordance with the following formula (3) so as to promote generation of $Al_2O_3$, resulting in elevation of the melting point. For these reasons, the content of $Li_2O_3$ is determined to range from 3 to 20 wt %.

$$m(Li_2O)+nM \rightarrow 2mLi+(MnOM) \quad (3)$$

wherein M represents a reducing element, and m and n are coefficients. CaO, $Al_2O_3$: from 10 to 35 wt %

The contents of CaO and $Al_2O_3$ respectively range from 10 to 35 wt %. It is therefore necessary to draw an upper limit of these contents in order that the powder will not lose the lubricating functions due to enhancement of melting point and viscosity. It is also necessary that CaO and $Al_2O_3$, when mixed as externally incurred impurities, do not cause a substantial change in the physical properties. Considering these requirements while taking into account also other components, the upper limit of the CaO content, as well as that of $Al_2O_3$, is set to be 35 wt %. Conversely, when the contents of CaO and $Al_2O_3$ are below 10 wt %, contents of other components are increased beyond the limits specified above. The lower limits of the contents of CaO and $Al_2O_3$, therefore, is set to be 10 wt %. F: 15 wt % or less F is necessary for the purpose of adjustment of the melting point and viscosity. An F content exceeding 15 wt % causes gasification of fluorides due to reaction between F and other components of the powder, and can no more function as an element for controlling the physical properties. In addition, such large content of F generates white smoke to impair the work. The F content, therefore, is to be limited to be 15 wt % or less. $Na_2O$: 20 wt % or less $Na_2O$ provides the same advantage as F. The content of $Na_2O$ is determined in accordance with factors such as the casting rate and powder consumption, and is preferably set to be not more than 20 wt %. Addition of $Na_2O$ in excess of 20 wt % poses a risk of melt down of the immersed nozzles. BaO: from 5 to 40 wt %

BaO is added preferably in an amount ranging from 5 to 40 wt %, in order to reduce viscosity and to prevent crystalline precipitation. Addition of BaO also is advantageous in that this compound does not cause reducing reaction with Al. The effect of prevention of crystalline precipitation is not appreciable when the BaO content is less than 5 wt %, whereas addition of BaO in excess of 40wt % causes a saturation in the effect of reducing viscosity. The content of BaO, therefore, is determined to range from 5 to 40 wt %. MgO: 10 wt % or less MgO is an element which lowers the melting point of the powder as is the case of $Li_2O$ and $TiO_2$, and is added as necessitated. The content of MgO, however, is limited to be 10 wt % or less, since the effect to lower the melting point is appreciable only in this range of MgO content.

The powder of the invention also can contain suitable amounts of metal fluorides such as LiF and NaF as solvents in addition to BaO and MgO, as well as suitable amounts of C, BN and so forth as aggregates. C, BN: 0.5 to 4.0 wt %

When C and/or BN is used as aggregates, the rate of formation of the molten slag layer is lowered when the content of C and/or BN exceeds 4 wt%, resulting in slag inclusion. When C alone is used, thermit reactions take place in accordance with the aforesaid formulae (1), (2) and (3) particularly when the C content exceeds 4 wt %, with the result that C as aggregates is burned to generate flame, thus affecting safety of the casting operation. Conversely, the effect of C and/or BN as aggregate is not noticeable when the content is below 0.5 wt %. For these reasons, the content of C and/or BN is determined to range from 0.5 to 4.0 wt %.

Examples:

Slabs having a cross-section of 200 mm thickness and 1000 mm width were prepared by continuous casting from three types of steels A, B and C having chemical compositions shown in Table 1.

Referring to Table 1, steels A and B are rich in reducing metal elements such as Al, Ti, REM and so forth, while the steel C has small contents of Al and Ti and is substantially free of REM. The continuous casting was conducted by using mold powders of the invention having compositions as shown in Table 2. For the purpose of comparison, continuous casting also was conducted by using a $CaO$-$SiO_2$ type powder having a composition disclosed in Japanese Patent Laid-Open No. 61-186155. Table 3 shows the results of the continuous casting: specifically, defects caused by inclusion of powder and number of bleed defects at the slab surface, and yield after conditioning of the slab surface.

TABLE 1

| TYPE OF STEEL | CHEMICAL COMPOSITION (wt %) | | | | | | | |
|---|---|---|---|---|---|---|---|---|
| | C | Si | Mn | Ni | Cr | Al | Ti | La |
| A | 0.02 | 0.15 | 0.17 | 1.0 | 13 | 1 | 0.4 | — |
| B | 0.002 | 0.1 | 0.4 | — | 20 | 5 | 0.02 | 0.10 |
| C | 0.10 | 0.30 | 0.80 | 0.10 | 0.15 | 0.02 | 0.08 | — |

TABLE 2

| POWDER SAMPLE NO. | CHEMICAL COMPOSITION (wt %) C | BN | CaO | $Al_2O_3$ | $TiO_2$ | $Li_2O$ | BaO | MgO | $Na_2O$ | P* | $SiO_2$ | MELTING POINT (°C.) | VISCOSITY (Poise at 1300° C.) | REMARKS |
|---|---|---|---|---|---|---|---|---|---|---|---|---|---|---|
| 1 | 1.0 | — | 23.9 | 19.9 | 4.0 | 14.1 | 28.7 | Tr. | 4.9 | 3.5 | Tr. | 1120 | 1.4 | Example of the Invention |
| 2 | 0.5 | 1.0 | 24.4 | 28.7 | 5.0 | 14.0 | 9.3 | Tr. | 9.4 | 6.7 | 1.0 | 1110 | 2.0 | |
| | — | 2.0 | 18.5 | 20.5 | 5.0 | 12.5 | 15.0 | 7.0 | 6.3 | 10.7 | 2.5 | 980 | 1.5 | |
| 4 | 1.0 | — | 21.1 | 0.9 | 7.7 | 4.0 | 9.6 | 8.0 | 7.7 | 5.5 | 34.5 | 820 | 1.1 | Comparative Example |
| 5 | 4.0 | — | 18.4 | 26.2 | 5.0 | 14.4 | 30 | Tr. | 1.4 | 0.6 | Tr. | 1140 | 1.0 | Example of the Invention |
| 6 | 2.0 | — | 20.0 | 16.4 | 5.0 | 8.0 | 20.6 | 5.0 | 8.0 | 14.5 | 0.5 | 1150 | 0.9 | |
| 7 | 4.0 | — | 24.6 | 30.0 | 3.0 | 5.4 | 13.8 | Tr. | 17.5 | 1.2 | 0.5 | 1180 | 1.3 | |

*P indicates total content of F in flourides such as LiF, NaF and so forth.

TABLE 3

| POWDER SAMPLE NO. | TYPE OF CAST STEEL | NO. OF BLEEDS GENERATED (per $m^2$) | NO. OF DEFECTS CAUSED BY POWDER INCLUSION (per $m^2$) | YIELD AFTER CONDI-TIONING (%) | SMOKE/FLAME GENERATION DURING CASTING | REMARKS |
|---|---|---|---|---|---|---|
| 1 | A | 0 | 0.01 | 99.8 | Smoke/flame generated (Lighter than 4) | Example of the Invention |
| 2 | B | 0.15 | 0.05 | 99.0 | Slight smoke/flame genertion | |
| | B | 0.20 | 0.21 | 99.2 | Almost no smoke/flame | |
| 4 | A | 2.4 | 2.9 | 95.6 | Average level of smoke/flame | Comparative Example |
| 4 | B | 1.3 | 1.0 | 96.5 | More smoke/flame than average level | |
| 4 | C | 0.05 | 0.24 | 99.5 | Almost no smoke/flame | |
| 1 | C | 0 | 0 | 100 | Almost no smoke/flame | Example of the Invention |
| 5 | B | 0 | 0 | 100 | Smoke/flame generated (Lighter than 4) | |
| 6 | B | 0.1 | 0 | 98.9 | Smoke/flame generated (Lighter than 4) | |
| 7 | B | 0.15 | 0 | 98.0 | Smoke/flame generated (Lighter than 4) | |

From Table 3, it will be seen that steels rich in slag reducing metal elements such as Al, Ti and REM can be done satisfactorily when the mold powder used is one of the powder sample Nos. 1 to 7 except for No.4. More specifically, when these mold powders were used, generation of bleeds and defects caused by inclusion of powder are remarkably suppressed. In addition, yield after conditioning of the steel slab surface, in terms of [{(weight before conditioning-weight reduction caused by conditioning)/(weight before conditioning)}×100%] was also improved significantly. In particular, these advantageous effects were remarkable particularly on the steels A and B which are rich in Al, Ti and REM. In contrast, many defects were observed, as well as small yield, when the continuous casting was conducted by using the mold powder sample No. 4 which is a conventional powder. This tendency is noticeable particularly in the cases of steels A and B having large contents of Al, Ti and REM.

As will be understood from the foregoing description, according to the present invention, the powder composition is so determined as to minimize the contents of oxides which are liable to react with strong reducing elements in the molten steel such as Al, Ti, REM and so forth, while retaining characteristics required for mold powder. Consequently, problems are eliminated such as generation of defects such as bleeds in the product slab surface, defects caused by inclusion of powder, reduction in the yield due to conditioning, generation of flame during casting, and so forth.

What is claimed is:

1. A mold powder for continuous casting, having a composition which consists essentially of from 10 to 35 wt % of CaO, from 10 to 35 wt % of $Al_2O_3$, from 3 to 15 wt % of $TiO_2$, from 3 to 20 wt % of $Li_2O$, from 5 to 40 wt % of BaO, not more than 15 wt % of F, not more than 20 wt % of $Na_2O$, at least one from 0.5 to 4.0 wt % of BN and from 0.5 to 4.0 wt % of C, wherein the percentages are weight percentages and are selected to total 100%, and the balance inevitable impurities.

2. A mold powder for continuous casting, having a composition which consists essentially of from 10 to 35 wt % of CaO, from 10 to 35 wt % of $Al_2O_3$, from 3 to 15 wt % of $TiO_2$, from 3 to 20 wt % of $Li_2O$, from 5 to 40 wt % of BaO, not more than 10 wt % of MgO, not more than 15 wt % of F, not more than 20 wt % of $Na_2O$ at least one of from 0.5 to 4.0 wt % of BN and from 0.5 to 4.0 wt % of C, wherein the percentages are weight percentages and are selected to total 100%, and the balance inevitable impurities.

* * * * *